US012693063B2

(12) United States Patent
Radziwolek et al.

(10) Patent No.: US 12,693,063 B2
(45) Date of Patent: Jul. 28, 2026

(54) REFRIGERATION APPLIANCE, HEAT EXCHANGER ASSEMBLY FOR A REFRIGERATION APPLIANCE, METHOD FOR MOUNTING A FAN IN A HOUSING, AND METHOD FOR PRODUCING A HEAT EXCHANGER ASSEMBLY

(71) Applicant: BSH Hausgeräte GmbH, Munich (DE)

(72) Inventors: Daniel Radziwolek, Dillingen an der Donau (DE); Ming Zhang, Ulm (DE)

(73) Assignee: BSH Hausgeräte GmbH, Munich (DE)

( * ) Notice: Subject to any disclaimer, the term of this patent is extended or adjusted under 35 U.S.C. 154(b) by 99 days.

(21) Appl. No.: 18/832,195

(22) PCT Filed: Mar. 2, 2023

(86) PCT No.: PCT/EP2023/055378
§ 371 (c)(1),
(2) Date: Jul. 23, 2024

(87) PCT Pub. No.: WO2023/166152
PCT Pub. Date: Sep. 7, 2023

(65) Prior Publication Data

US 2025/0146734 A1 May 8, 2025

(30) Foreign Application Priority Data

Mar. 4, 2022 (DE) ..... 10 2022 202 214.9

(51) Int. Cl.
*F25D 17/06* (2006.01)

(52) U.S. Cl.
CPC ..... *F25D 17/067* (2013.01)

(58) Field of Classification Search
CPC ..... F25D 17/067
See application file for complete search history.

(56) References Cited

U.S. PATENT DOCUMENTS

2002/0157812 A1* 10/2002 Anderson ..... B60K 11/04 165/140
2019/0120541 A1* 4/2019 Yoo ..... F25D 21/14
2022/0205705 A1* 6/2022 Chhajed ..... F25D 23/006

FOREIGN PATENT DOCUMENTS

DE 102015221659 A1 5/2017
DE 102017213972 A1 2/2019
(Continued)

*Primary Examiner* — Elizabeth J Martin
(74) *Attorney, Agent, or Firm* — Laurence A. Greenberg; Werner H. Stemer; Ralph E. Locher

(57) ABSTRACT

A heat exchanger assembly has: a housing, which defines an accommodation space extending along a longitudinal axis between a first opening and a second opening; a heat exchanger, accommodated in the accommodation space of the housing; and a fan, which is accommodated in the accommodation space of the housing and is configured to draw in a gaseous fluid through the first or the second opening of the housing, to conduct the fluid through the heat exchanger and to blow the fluid out through the other opening of the housing. The housing further has a side opening and a latching structure located in the region of the side opening. The fan can be inserted into the accommodation space through the side opening in a transverse direction extending transversely to the longitudinal axis and is latched to the housing by the latching structure at an edge region situated in the side opening.

18 Claims, 4 Drawing Sheets

(56) References Cited

FOREIGN PATENT DOCUMENTS

| | | | |
|---|---|---|---|
| EP | 3473953 | B1 | 4/2020 |
| JP | H11211316 | A | 8/1999 |
| KR | 19990028915 | U | 7/1999 |

* cited by examiner

REFRIGERATION APPLIANCE, HEAT EXCHANGER ASSEMBLY FOR A REFRIGERATION APPLIANCE, METHOD FOR MOUNTING A FAN IN A HOUSING, AND METHOD FOR PRODUCING A HEAT EXCHANGER ASSEMBLY

FIELD AND BACKGROUND OF THE INVENTION

The present invention relates to a refrigeration appliance, in particular a household refrigeration appliance such as a refrigerator, freezer or combined fridge-freezer. The invention also relates to a heat exchanger assembly for a refrigeration appliance, to a method for installing a fan in a housing of a heat exchanger assembly, and to a method for producing a heat exchanger assembly.

PRIOR ART

In household refrigeration appliances, a heat exchanger assembly may be provided for heat emission to the surroundings, which heat exchanger assembly has a heat exchanger or line arrangement and a blower or fan for transporting air via the line arrangement. Heat exchanger assemblies of this kind are typically arranged in the machine compartment.

A heat exchanger assembly is disclosed in DE 10 2015 221 659 A1 which is arranged in a machine compartment of a refrigeration appliance and which has an MPE condenser and a fan. Here, "MPE" is an abbreviation for the expression "multiport extruded" and describes a profile that has a plurality of extruded lines.

Moreover, DE 10 2017 213 972 A1 describes a heat exchanger assembly arranged in a machine compartment of a refrigeration appliance with a condenser and a fan which transports air via the condenser, wherein the condenser and the fan are arranged in a shared duct or are surrounded by the duct. The condenser comprises a multi-chamber MPE profile through which refrigerant flows. The duct is adapted, in terms of its internal diameter, to the exterior diameter of the condenser and fan respectively. Inside the machine compartment, the heat exchanger assembly is separated by a partition, wherein one end of the duct is arranged in a recess of the partition and a sealing lip is provided between the duct and the partition.

In such heat exchanger assemblies with a heat exchanger and a fan which are integrated in a housing or duct, it can occur that the housing is made to vibrate by the operation of the fan, which can result in noise emissions. The installation of the condenser and heat exchanger usually takes place along the longitudinal axis of the housing or through the apertures at the end of the duct, which are often difficult to access in the machine compartment.

SUMMARY OF THE INVENTION

It is an object of the present invention to provide improved solutions for heat exchanger assemblies of refrigeration appliances, in particular solutions in which an emission of noise is reduced and which facilitates simple installation.

This object is achieved in accordance with the invention by a heat exchanger assembly with the features of the independent heat exchanger assembly claim, a refrigeration appliance with the features of the independent refrigeration appliance claim, by a method with the features of the first independent method claim and by a method with the features of second independent method claim.

According to a first aspect of the invention, a heat exchanger assembly comprises a housing which defines a receiving space extending between a first aperture and a second aperture along a longitudinal axis, a heat exchanger which is accommodated in the receiving space of the housing and which is optionally retained by the housing, and a fan or blower which is accommodated in the receiving space of the housing and which is designed to draw in a gaseous fluid via the first or the second aperture of the housing, to conduct it via the heat exchanger and to expel it via the respective other aperture of the housing. The housing further has a side aperture and a latching structure arranged in a region of the side aperture, wherein the fan can be inserted into the receiving space through the side aperture along a transverse direction extending transversely in relation to the longitudinal axis and is latched onto the housing at an edge region situated in the side aperture by means of the latching structure.

According to a second aspect of the invention a refrigeration appliance, in particular household refrigeration appliance, such as, for example, a refrigerator, a freezer or a combined fridge-freezer is provided. The refrigeration appliance comprises at least a refrigeration compartment for accommodating refrigerated goods, a machine compartment separate from the refrigeration compartment, and a refrigerant circuit for dissipating heat from the refrigeration compartment to the surroundings, wherein the refrigerant circuit has a heat exchanger assembly according to the first aspect of the invention which is arranged in the machine compartment.

According to a third aspect of the invention a method is provided for producing a heat exchanger assembly, in particular, the heat exchanger assembly according to the first aspect of the invention. The method comprises inserting a heat exchanger into a receiving space of a housing, wherein the housing has a first and a second aperture, between which the receiving space extends along a longitudinal axis, and inserting a fan into a receiving space through a side aperture of the housing along a transverse direction extending transversely in relation to the longitudinal axis, such that an edge region of the fan is positioned in the side aperture and is latched to the housing by means of a latching structure embodied in the region of the side aperture.

According to a fourth aspect of the invention, a method for installing a fan in a housing of a heat exchanger assembly is provided, wherein the housing defines a receiving space extending along a longitudinal axis between a first aperture and a second aperture and has a side aperture and a latching structure arranged in the region of the side aperture. The method comprises inserting the fan in the receiving space through the side aperture along a transverse direction extending transversely in relation to the longitudinal axis, such that an edge region of the fan is positioned in the side aperture and is latched to the housing by means of the latching structure.

The present invention is based on the concept of simplifying the installation of a fan in a housing of a heat exchanger assembly, in that the housing is provided with a side aperture, through which the fan can be inserted into the housing laterally or transversely in relation to the longitudinal axis of the housing. The housing is designed as a channel which extends along a longitudinal axis with opposing apertures. The side aperture forms a recess in a side or peripheral wall of the housing, which side or peripheral wall encloses the channel. For simple and reliable fastening of the fan, the housing is provided with a latching structure in the region of the side aperture, which latching structure, for example, protrudes into the side aperture. The latching structure engages behind the edge region of the fan, for example a frame of the fan, which edge region is situated in the side aperture, and fastens the fan in a positive-fit manner. By way of the fixed fastening of the fan by means of the latching structure, noise emissions from the fan are also reduced.

Advantageous embodiments and developments emerge from the subclaims relating to the independent claims in connection with the description.

According to some embodiments it can be provided that the fan is retained, relative to the transverse direction, between the latching structure and a contact surface of the housing which is opposite the side aperture. The fan can thus be, to a certain extent, clamped at opposite ends between the contact surface, which can be formed, for example, by a section of the side wall of the housing. With a simple structure in terms of its design, a reliable fastening of the fan to the housing is thus achieved, which further reduces the noise emission from the fan.

According to some embodiments, it can be provided that the latching structure protrudes into the side aperture along the longitudinal axis and is elastically deformable along the longitudinal axis. The latching structure can, for example, be embodied so as to be integral with the housing. In particular, the latching structure can be arranged and embodied such that when the fan is inserted into the side aperture, the latching structure is deformed and displaced by the fan in a direction which runs parallel to the longitudinal axis and snaps back behind the edge region of the fan for rear-engagement of the fan. The latching structure is therefore embodied as self-latching and inserting the fan into the side aperture is all that is required to latch the latching structure.

According to some embodiments, it can be provided that the latching structure has at least a latching hook, which engages behind the edge region of the fan relative to the transverse direction.

According to some embodiments, it can be provided that the fan has a blade arrangement rotatable about an axis of rotation by way of a motor, for example an electric motor, wherein the motor and the axis of rotation are arranged in the region of the longitudinal axis of the housing, in particular coaxially to the longitudinal axis, wherein the latching structure is arranged in a first edge region and/or a second edge region of the side aperture relative to a height direction which extends transversely in relation to the longitudinal axis and to the transverse direction. The latching structure is thus arranged at a distance from the longitudinal axis relative to the height direction. When the fan is inserted into the housing through the side aperture, the latching structure is consequently also situated at a distance from the fan motor. In this manner, an undesired mechanical interaction is prevented, which could potentially lead to damage to the motor and/or the blade arrangement.

According to some embodiments, it can be provided that the housing has a guide structure which extends in the transverse direction in a manner which is flush with the side aperture, which guide structure retains the fan relative to the longitudinal axis and guides the fan in the transverse direction when the fan is inserted into the side aperture. The guide structure can have at least two guide webs situated at a distance along the longitudinal axis, wherein the fan is retained between the guide webs relative to the longitudinal axis. In particular, at least one first and at least one second guide web is provided which run parallel to one another and are situated at a distance along the longitudinal axis. The guide webs protrude from a respective side wall of the housing. When the fan is inserted into the side aperture, it is guided in the receiving space of the housing by the guide structure, for example the guide webs thereof, in the transverse direction. As a result, the installation of the fan is further simplified. Moreover, the position of the fan is additionally set relative to the longitudinal axis, which further reduces the noise emissions.

According to some embodiments it can be provided that the side aperture is embodied in the region of the first aperture of the housing. In particular, the side aperture and the first aperture can merge into one another, wherein the side aperture and the peripheral aperture are delimited relative to a direction, for example the height direction, by the same side wall sections. Alternatively or in addition, the side aperture can have an open circumference relative to the longitudinal axis. The embodiment of the side aperture in the region of the first aperture simplifies the structural design of the housing. Furthermore, the fan is thus positioned close to the first aperture, which reduces flow losses.

According to some embodiments it can be provided that the housing has a first wall section which delimits the side aperture in a first direction relative to the longitudinal axis and transverse webs extending in the transverse direction, which protrude at opposite sides into the first aperture and delimit the side aperture in a second direction relative to the longitudinal axis, wherein the edge region of the fan is arranged, relative to the longitudinal axis, between the first wall section and the transverse webs. The transverse webs can be formed, for example, by the second guide webs. Accordingly, the second guide webs or transverse webs and the wall section are arranged opposite one another relative to the longitudinal axis, such that the edge region of the fan is reliably fastened relative to the longitudinal axis.

According to some embodiments it can be provided that the latching structure is arranged on the first wall section. For example, the latching structure can be embodied so as to be integral with the wall section, protrude beyond this wall section and be elastically deformable, as described above. The second guide webs thus form a counter-bearing for the fan when it is inserted into the side aperture and pushes back the latching structure. The installation of the fan is further simplified in this manner.

According to some embodiments it can be provided that the heat exchanger is embodied as an MCHE heat exchanger. Here, "MCHE" is the abbreviation for "micro channel heat exchanger". Condensers of this kind can, in particular, be equipped with a "multiport extrusion pipe (MPE), that is, an extruded duct which has a plurality of channels in its interior. Heat exchangers of this kind have a particularly compact structure and are therefore particularly suitable for arrangement in a housing together with a fan.

According to some embodiments it can be provided that the housing is formed from a solid material. A solid material offers the advantage that a relatively rigid housing with minimal wall thickness is viable. A compact housing can then be realized which can be accommodated more easily in the machine compartment of the refrigeration appliance. Furthermore, in combination with the latching structure, despite the limited elasticity of the solid material in comparison to a foam material, for example, a reliable fastening which reduces noise emissions can be realized.

According to some embodiments it can be provided that the housing is manufactured from a plastic material, such as polypropylene, in particular in an injection molded method.

BRIEF DESCRIPTION OF THE FIGURES

The invention is described below with reference to the figures in the drawings. In the figures.

In the figures, identical reference characters refer to identical or functionally identical components, unless otherwise specified.

DETAILED DESCRIPTION OF THE INVENTION

Figure 1:
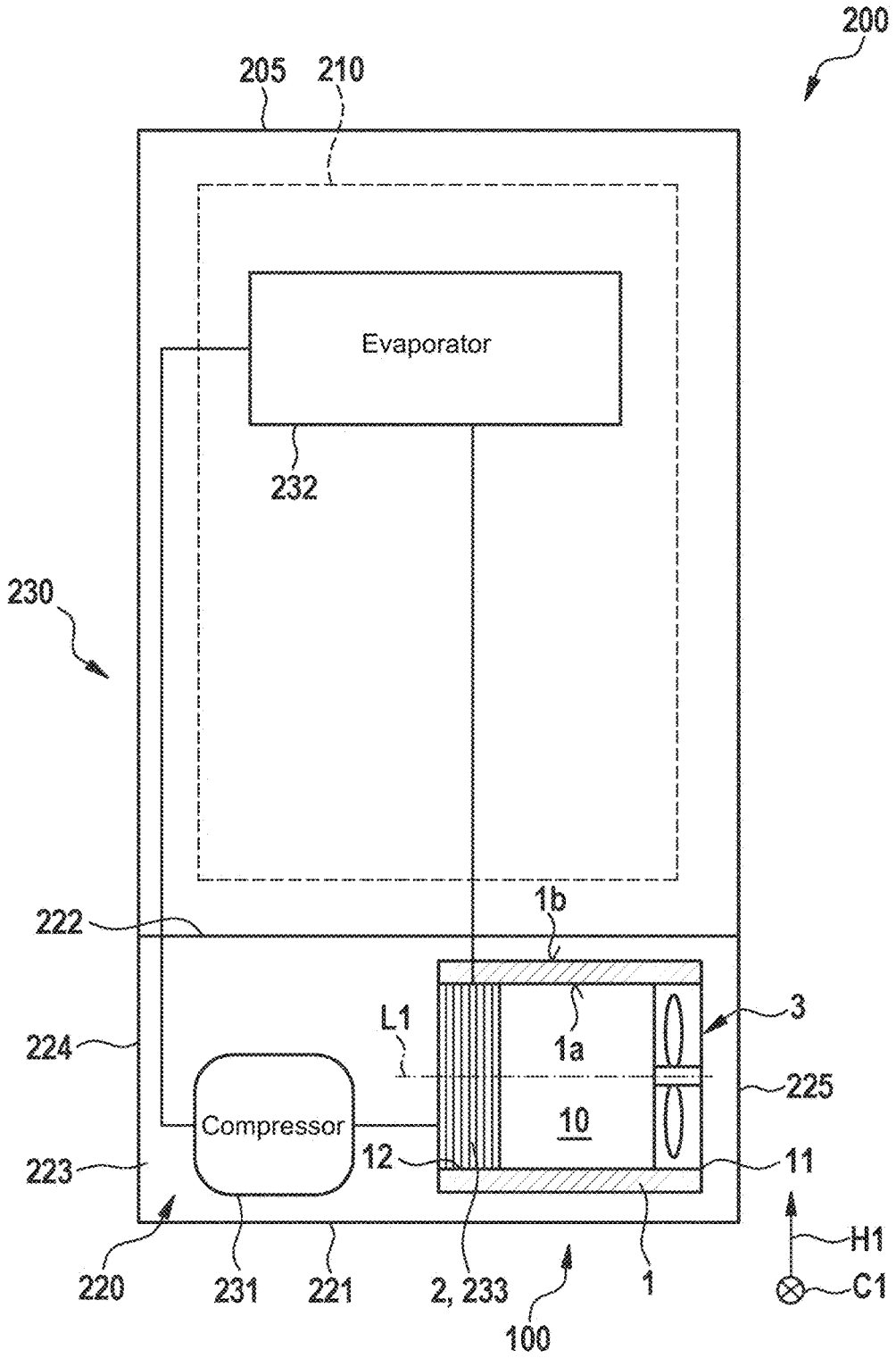
FIG. 1 shows a simplified, schematic side view of a refrigeration appliance according to an exemplary embodiment of the invention.

FIG. 1 shows schematically and by way of example a refrigeration appliance 200, in the form of a refrigerator, for example. In general, the refrigeration appliance 200 can be a household refrigeration appliance, that is, for example, a refrigerator, a freezer, a combined fridge-freezer or the like. As shown by way of example in FIG. 1, the refrigeration appliance 1 can have at least one refrigeration compartment 210, a machine compartment 220 and a refrigerant circuit 230.

The refrigeration compartment 210 is illustrated symbolically in FIG. 1 by a rectangle with dashed lines and serves for accommodating refrigerated goods. The refrigeration compartment 210 can be defined by a container which is accommodated in a carcass 205.

The machine compartment 220 is only schematically illustrated in FIG. 1 and is a receiving space which is separate from the refrigeration compartment 210 for accommodating components of the refrigerant circuit 230. As shown by way of example in FIG. 1, the machine compartment 220 can be arranged, for example, in a region of the carcass 205 which is close to the bottom. In general, the machine compartment is delimited by at least two delimiting structures which are opposite one another, as shown schematically in FIG. 1, for example, by a bottom 221 and a ceiling 222 opposite therefrom. The machine compartment 220 is preferably further delimited by a rear wall 223, which extends between bottom 221 and ceiling 222. Side walls 224, 225 can also be provided as an option, which extend transversely in relation to the rear wall 223 at opposite ends of the bottom 221 and ceiling 222 and therebetween, as is illustrated schematically in FIG. 1.

The refrigerant circuit 230 is only schematically illustrated in FIG. 1 and is embodied to circulate a refrigerant in order to dissipate heat from the refrigeration compartment 210 and emit it to the surroundings. The refrigerant circuit 230 can have, in particular, a compressor 231 for circulating the refrigerant, an evaporator 232 connected to a pressure connection of the compressor 231 for absorbing heat from the refrigeration compartment 210 and a heat exchanger assembly 100 with a condenser 2, 233 for emitting heat to the surroundings.

As illustrated schematically in FIG. 1, the heat exchanger assembly 100 is arranged in the machine compartment 220. As shown further in FIG. 1, the compressor 231 is also accommodated in the machine compartment 220.

Figure 2:
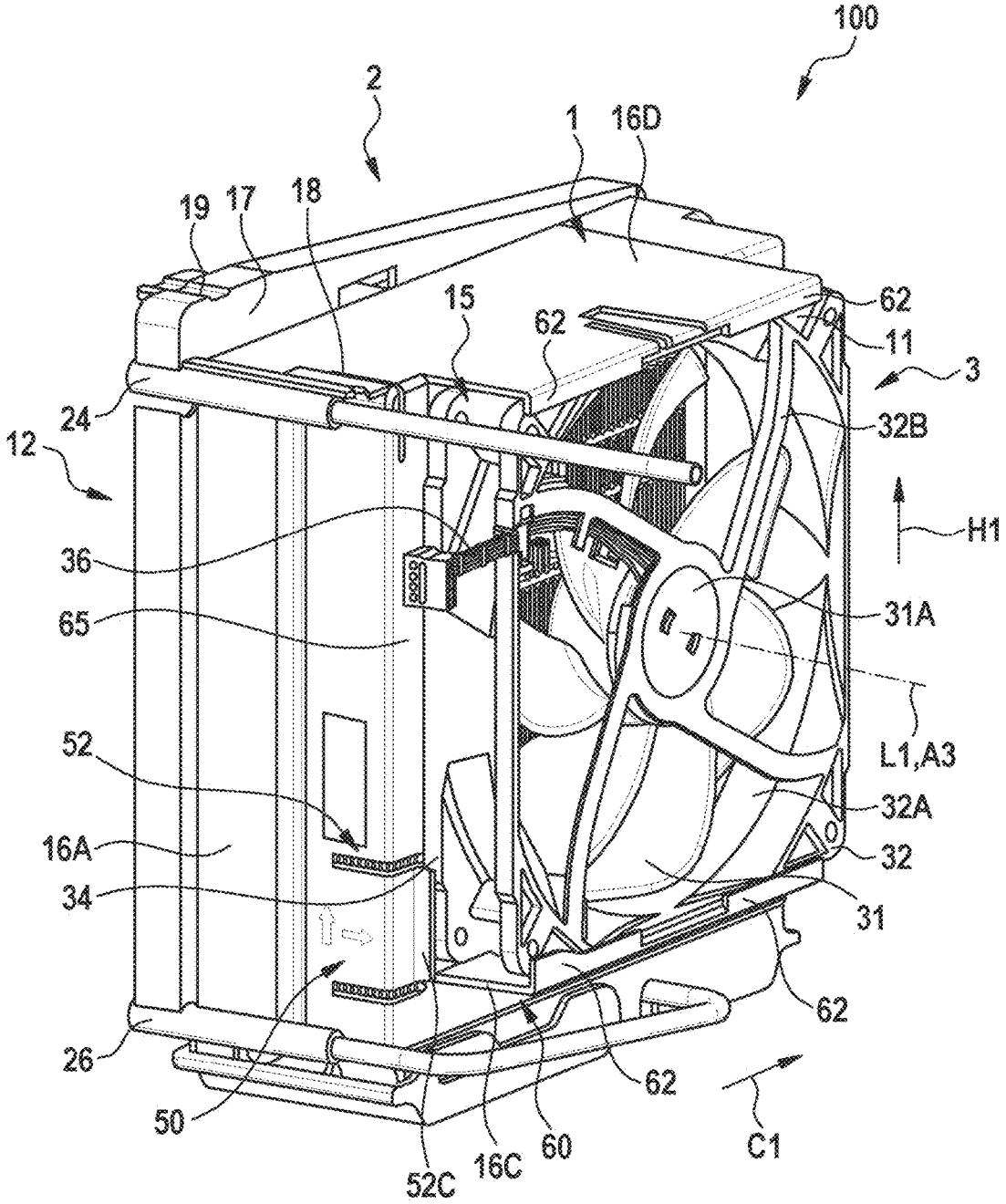
FIG. 2 shows a perspective view of a heat exchanger assembly according to an exemplary embodiment of the invention.
Figure 3:
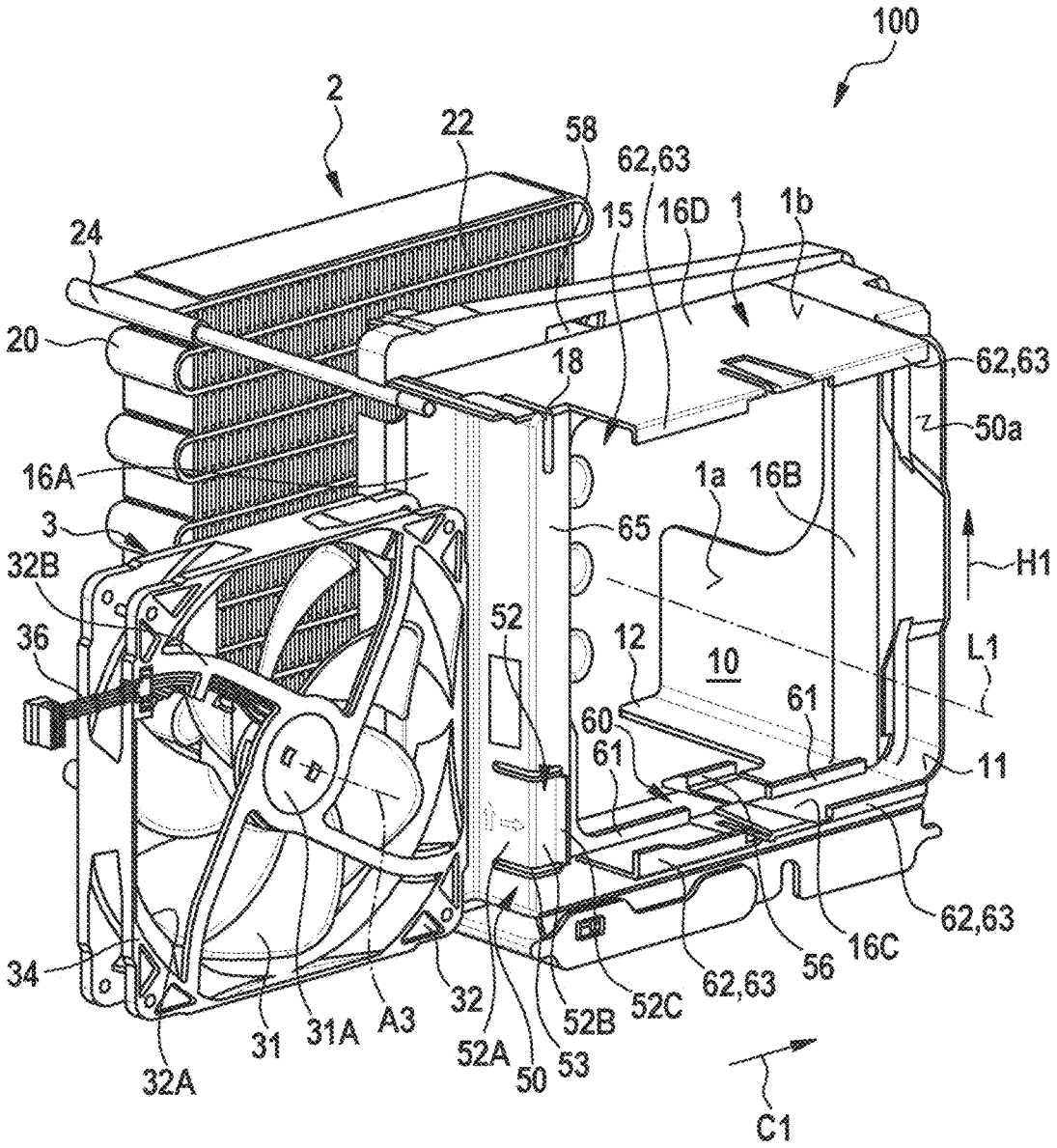
FIG. 3 shows an exploded representation of the heat exchanger assembly shown in FIG. 2.

In FIG. 1, the heat exchanger assembly 100 is only illustrated schematically in section. FIG. 2 shows, by way of example, a perspective view of the heat exchanger assembly 100. FIG. 3 shows an exploded view of the heat exchanger assembly 100 shown in FIG. 2. As can be seen in FIGS. 1 and 3 in particular, the heat exchanger assembly 100 has a housing 1, a heat exchanger 2 and a fan 3.

As is shown by way of example in FIGS. 1 and 3, the housing 1 defines a receiving space 10, which is enclosed by an internal surface 1*a* of the housing 1. The receiving space 10 extends between a first aperture 11 and a second aperture 12 along a longitudinal axis L1. The housing 1 thus forms a channel extending along the longitudinal axis L1 between the first aperture 11 and the second aperture 12. An external surface 1*b* of the housing, which is situated opposite the internal surface 1*a* relative to a radial direction R1 which extends perpendicularly to the longitudinal axis L1 defines an outer periphery of the housing 1. As shown by way of example in FIGS. 2 and 3, the housing 1 can have, for example, an outer periphery which is essentially rectangular, with two first side walls 16A, 16B which are opposite one another and extend in a height direction H1 transversely in relation to the longitudinal axis L1, as well as second side walls 16C, 16D which are opposite one another and which extend between the first side walls 16A, 16B in a transverse direction C1 which extends transversely in relation to the height direction H1 and to the longitudinal axis L1. The housing 1 can be formed in particular from a solid material. The housing can be manufactured, for example, from a plastic material, such as polypropylene, in particular in an injection molded method.

As shown in FIGS. 2 and 3, the housing 1 has a side aperture 15 and a latching structure 50.

The side aperture 15 extends between the external surface 1*b* and the internal surface 1*a* of the housing 1. As shown in FIGS. 2 and 3 by way of example, the side aperture 15 can be embodied in the first side wall 16A, for example. The side aperture 15 can be delimited relative to the height direction H1 by the second side walls 16C, 16D, for example. It is shown by way of example in FIGS. 2 and 3 that the side aperture 15 can be situated in the region of the first aperture 11 and as a result at an axial end of the housing 1. As is shown in FIGS. 2 and 3, the side aperture 15 can be delimited here by a wall section 65 in a first direction relative to the longitudinal axis L1, which first direction extends in the transverse direction C1. The wall section 65 can, as an option, extend between both second side walls 16C, 16D relative to the height direction H1. The side aperture 15 can be delimited in a second direction along the longitudinal axis L1, in particular in the direction of the first aperture 11, by transverse webs 62 which extend in the transverse direction C1 and which protrude into opposite sides in the first aperture 11. At least one transverse web 62 can be provided on both second side walls 16C, 16D, for example, which extends in the transverse direction C1 and protrudes from the respective second side wall 16C, 16D relative to the height direction H1. Two transverse webs 62 are provided on each second side wall 16C, 16D shown purely by way of example in FIGS. 2 and 3, which transverse webs are arranged at a distance from one another in the transverse direction C1.

The transverse webs 62 can be part of, in particular, a guide structure 60 which runs into a receiving space 10 and extends flush with the side aperture 15 in the transverse direction C1. As shown by way of example in FIG. 3, the guide structure 60 can have first guide webs 61 and second guide webs 63, wherein the second guide webs 63 are formed by the transverse webs 62. The first and second guide webs 61, 63 extend parallel to one another in the transverse direction C1 in each case and are arranged at a distance from one another along the longitudinal axis L1. In FIG. 3 it is shown by way of example that the guide webs 61, 63 are embodied on one of the second side walls 16C, 16D, namely on the side wall 16C. Alternatively or in addition, first and second guide webs 61, 63 can be provided on the other second side wall 16D.

The latching structure 50 is embodied in general in the region of the side aperture 15 and serves for latching the fan 3 to the housing 1, as will be explained in detail in the following. As shown in FIG. 3 in particular, the latching structure can be embodied on the wall section 65, for example. The latching structure 50 can, for example, be embodied so as to be integral with the housing 1 and protrude from the wall section 65 relative to the longitudinal axis L1, such that the latching structure 50 protrudes into the side aperture 15. In FIG. 3 a latching structure 50 realised as a latching hook 52 is shown by way of example. The latching hook 52 has a first limb 52A embodied so as to be integral with the first side wall 16A, in which side wall the side aperture 15 is embodied, a second limb 52B connected to the first limb 52A, which runs in the transverse direction C1 parallel to the wall section 65, and a latching projection 52C which protrudes relative to the longitudinal axis L1 from one end of the second limb 52A and thus from the wall section 65 and protrudes into the side aperture 15. The first and second limb 52A, 52B, relative to the height direction H1, and the second limb additionally relative to the transverse direction C1 are separated from the side wall 16A and the wall section 65 by of way a continuous slot 53. A latching hook can also be realized merely by the second limb 52B and the latching projection 52C. In this case, the slot 53 ends at the transition from the wall section 65 to the side wall 16A.

The latching structure 50 is elastically deformable, in particular along the longitudinal axis L1. In the latching hook 52 shown by way of example in FIG. 3, an elastic deformation is possible in that the latching projection 52C can be pushed back from the side aperture 15 through application of a force directed along the longitudinal axis L1.

The heat exchanger 2 can be integrated, for example, as a condenser 233 in the refrigerant circuit 230 of the refrigeration appliance 200. In FIG. 1, the heat exchanger 2 is illustrated merely symbolically as a block. As shown by way of example in FIG. 3, the heat exchanger 2 can have a line arrangement 20 which extends in a meandering fashion for conducting the refrigerant. Further, fins or other cooling structures 22 can be connected to the line arrangement 20, in order to increase the heat-conducting surface of the heat exchanger 2. The heat exchanger 2 can also have line connections 24, 26 by way of which the refrigerant of the line arrangement 20 can be supplied and discharged. In FIG. 3, a heat exchanger 2 realised as an MCHE condenser is illustrated purely by way of example.

The heat exchanger 2 is accommodated in the receiving space 10 of the housing 1. The heat exchanger 2 can be arranged in the region of or adjacent to the second aperture 12, for example, as is illustrated by way of example in FIGS. 1 and 2. The heat exchanger 2 can optionally rest against the internal surface 1*a*. Furthermore, the heat exchanger 2 can be latched to the housing 1 at its edge region 23 by elastic clips 56, 58 which are embodied on the second side walls 16C, 16D. The heat exchanger 2 is generally retained in position by the housing itself.

The fan 3 can be embodied in particular as an axial blower, as shown by way of example in FIGS. 1 to 3. As shown in FIGS. 2 and 3, the fan 3 can have a blade arrangement 31, a drive motor 31A, for example in the form of an electric motor, and a frame 32. The frame 32 can be a closed frame, for example rectangular-shaped, and have a central recess 32A, as is shown in FIGS. 2 and 3. Moreover, the frame 32 can have a retaining structure 32B, which protrudes into the central recess 32A. The blade arrangement 31 is arranged in the central recess 32A of the frame 32 and is rotatably mounted on the retaining structure 32B about an axis of rotation A3. The motor 31A is likewise mounted on the retaining structure 32B and is coupled to the blade arrangement 31 in order to drive said blade arrangement.

As shown in FIGS. 1 and 2, the fan 3 is accommodated in the receiving space 10 of the housing 1. By rotating the blade arrangement 31 about the axis of rotation A3, which, for example, can be arranged coaxially to the longitudinal axis L1 as shown in FIG. 2, a gaseous fluid can be drawn in through the first or the second aperture 11, 12 of the housing 1 by means of the fan 3, conducted via the heat exchanger 2 and expelled via the respective other aperture 12, 11 of the housing 1. It is shown in FIGS. 2 and 3 by way of example that the heat exchanger 2 is arranged on a suction side of the fan 3, that is, the fan 3 draws in air through the second aperture 12 and outputs air through the first aperture 11. Air guidance in the reverse is also conceivable, however.

For installation, the fan 3 can be inserted into the receiving space 10 through the side aperture 15 along the transverse direction C1. FIG. 2 shows the fan 3 in the installed state, in which it is arranged in the receiving space 10 of the housing 1. Here, an edge region 34 of the fan 3, for example an edge or end region of the frame 32, lies in the side aperture 15. Further, the latching structure 50 engages behind the edge region 34 of the fan 3 relative to the transverse direction C1, in order that the edge region 34 is latched to the housing 1 by means of the latching structure 50. As can be seen from FIG. 2 in particular, the latching projection 52C, for example, of the latching hook 52 can overlap the frame 32 of the fan 3 relative to the longitudinal axis L1 and thus engage therebehind. As an option, the frame 32 of the fan 3 touches a contact surface 50*a* of the housing 1 with an opposite end relative to the transverse direction C1 of the latching structure 50, which contact surface can be formed, for example, by the first side wall 16B, as shown by way of example in FIG. 3. In general, the fan 30 can be retained between the latching structure 50 and a contact surface 50*a* of the housing 1 situated opposite the side aperture 15 relative to the transverse direction C1. The fan 3 can be retained by the guide structure 60, relative to the longitudinal direction L1, for example by the first and second guide webs 61, 63, between which the frame 32 is arranged, as shown in FIG. 2. The edge region 34 of the fan 3 can be arranged between the wall section 65 and the transverse webs 62 relative to the longitudinal axis L1 in the region of the side aperture 15, as is likewise shown in FIG. 2.

The electrical connection of the motor 31A of the fan 3 can take place via a cable 36. In order to lay the cable 36 onto the housing 1 in a space saving manner and in which it is protected against external influences, a receiving slot 18 can be embodied in an end region of the wall section 65 and in the adjoining second side wall 16D, in which receiving slot the cable 36 can be laid. Thereby, contact, which is at risk of corrosion, between the cable 36, which typically a PVC cladding, and the line connection 24 formed usually from aluminum, is avoided. Furthermore, a groove 19 can be provided on a rib 17, which protrudes from the second side wall 16D in the height direction H1 in the region of the second aperture 12, in order to simplify cable passage.

Figure 4:
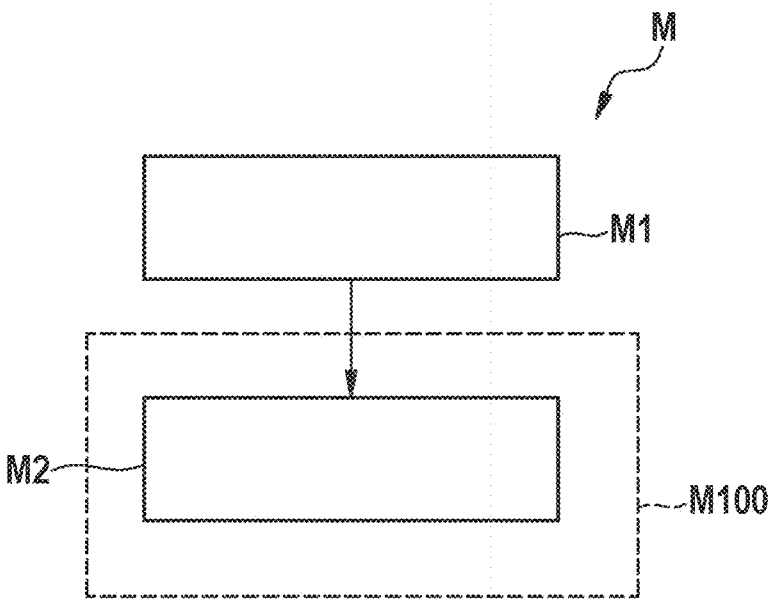
FIG. 4 shows a flowchart of a method according to an exemplary embodiment of the invention.

The fan 3 is particularly simple to install in the housing 1 by way of the side aperture 15 and the latching structure 50 provided thereon and is moreover securely fastened in the housing 1, which reduces noise emissions during operation of the heat exchanger assembly 100. Accordingly, a method M100 for installing the fan 3 in the housing 1 can be carried out in a particularly simple manner. FIG. 4 shows the flow diagram of such a method M100, which is explained below with reference to FIGS. 2 and 3.

The method M100 for installing the fan 3 comprises a step M2, in which the fan 3 is inserted into the receiving space 10 through the side aperture 15 along the transverse direction C1. The frame 32 of the fan 3 thereby applies a force to the latching structure 50, for example to the latching projection 52C and thereby deforms the latching structure 50 such that it is pushed back and creates space for the fan 3. During application of the force onto the latching structure 50 by the fan 3, the second guide webs 63, for example, can serve as a counter-bearing, on which the fan 3 is supported. For insertion of the fan 3 through the side aperture 15, it is advantageous if the latching structure 50 is arranged in an edge region of the side aperture 15 relative the height direction H1, as is shown by way of example in FIGS. 2 and 3, since in this manner, undesirable deformations of the fan 3, in particular in the edge region of the blade arrangement 31 or the motor 31A, are avoided.

The fan 3 is inserted into the housing 1 along the transverse direction C1 until the edge region 34 of the fan 3 is positioned in the side aperture 15 and the latching structure 50 is latched to the housing 1. In particular, the elastically deformable latching structure 50, in the form of a latching hook 52, for example, snaps back along the longitudinal axis L1, in order that it protrudes into the side aperture and engages behind the edge region 34 of the fan 3. Optionally, the fan 3 is inserted into the housing 1 along the transverse direction C1 until it touches the contact surface 50*a*. A distance between the contact surface 50*a* and the latching structure 50 along the transverse direction C1 can thereby be dimensioned in particular such that the latching structure 50 applies a clamping force which is directed along the transverse direction C1 onto the fan 3. During insertion, the fan 3 is guided by the guide structure 60 which is possibly provided, if applicable, in particular by the guide webs 61, 63 thereof, in the transverse direction C1.

As shown schematically in FIG. 4, the method M100 for installing the fan 3 can be part of a method M for manufacturing the heat exchanger assembly 100. The method M100 can however also be carried out separately therefrom if the fan 3 on the heat exchanger assembly 100 which is installed in the machine compartment 220 is to be exchanged, in the event of a service, for example. In this connection, a further advantage of the invention is made clear in FIG. 1: the heat exchanger assembly 100 can be positioned in the machine compartment 220 in particular, such that the longitudinal axis L1 runs at right angels to the side walls 224, 225 and the transverse direction C1 runs transversely in relation to the rear wall 223, wherein the side aperture 15 (not visible in FIG. 1 due to the sectional view) is situated facing away from the rear wall 223. The side aperture 15 is thus situated facing an access aperture of the machine compartment 220, and the fan 3 can be conveniently removed from the heat exchanger assembly 100 from behind and reinserted.

As has already been mentioned, the design of the housing 1 provides the advantage of a simple and fast installation of the heat exchanger assembly 100, with the side aperture 15 and also with the manufacturing method M. As shown schematically in FIG. 4, the method M for manufacturing the heat exchanger assembly 100 comprises a step M1, in which the heat exchanger 2 is inserted into the receiving space 10. For example, the insertion of the heat exchanger 2 can take place through the second aperture 12, wherein the heat exchanger 2 can be latched to the housing 1 by means of the clips 56, 58. As a result, the heat exchanger 2 is retained by the housing 1 itself. The heat exchanger 2 can of course also be fastened to the receiving space 10 in another manner by the housing 1 itself or in some other way.

Step M2 of the method M comprises inserting the fan 3 in the receiving space 10 through the side aperture 15 along the transverse direction C1, as described above. It should be noted that the sequence of steps M1 and M2 can be selected freely.

Although the present invention was currently described on the basis of exemplary embodiments, it is not restricted thereto, but can instead be modified in a variety of ways. In particular, combinations of the preceding exemplary embodiments are also conceivable.

REFERENCE CHARACTERS

1 Housing
1*a* Internal surface
1*b* External surface
2 Heat exchanger
3 Fan
10 Receiving space
11 First aperture
12 Second aperture
15 Side aperture
16A, 16B First side walls
16C, 16D Second side walls
17 Rib
18 Receiving slot
19 Groove
20 Line arrangement
22 Cooling structures
24, 26 Line connections
31 Blade arrangement
31A Motor
32 Frame
32A Central frame recess
32B Retaining structure
34 Edge region of the fan
36 Cable
50 Latching structure
50*a* Contact surface
52 Latching hook
52A First limb
52B Second limb
52C Latching projection
53 Slot
56, 58 Clips
60 Guide structure
61 First guide webs
62 Transverse webs
63 Second guide webs
100 Heat exchanger assembly
200 Refrigeration appliance
210 Refrigeration compartment
220 Machine compartment

221 Bottom
222 Ceiling
223 Rear wall
224 Side wall
225 Side wall
230 Refrigerant circuit
231 Compressor
232 Evaporator
233 Condenser
C1 Transverse direction
H1 Height direction
L1 Longitudinal axis
M Manufacturing method
M100 Installation method
M1, M2 Method steps

The invention claimed is:

1. A heat exchanger assembly, comprising:

a housing having a first aperture, a second aperture and a side aperture formed therein, said housing defining a receiving space extending between said first aperture and said second aperture along a longitudinal axis, said side aperture being situated at an axial end of said housing in a region of said first aperture;

a heat exchanger accommodated in said receiving space of said housing in a region of, or adjacent to, said second aperture;

a latching structure disposed in a region of said side aperture; and a fan accommodated in said receiving space of said housing and embodied to draw in a gaseous fluid through said first aperture or said second aperture of said housing, conduct the gaseous fluid via said heat exchanger and to expel the gaseous fluid via another of said first and second apertures of said housing, said fan being inserted into said receiving space through said side aperture at the axial end of said housing along a transverse direction extending transversely in relation to the longitudinal axis and latched to said housing by means of said latching structure on an edge region situated in said side aperture.

2. The heat exchanger assembly according to claim 1, wherein said housing has a contact surface situated opposite said side aperture relative to the transverse direction, said fan is retained between said latching structure and said contact surface of said housing.

3. The heat exchanger assembly according to claim 1, wherein said latching structure protrudes into said side aperture along the longitudinal axis and is elastically deformable along the longitudinal axis.

4. The heat exchanger assembly according to claim 1, wherein said latching structure has at least one latching hook, which engages behind said edge region of said fan relative to the transverse direction.

5. The heat exchanger assembly according to claim 1, wherein:

said fan has a motor and a blade configuration which rotates about an axis of rotation by way of said motor;

said motor and the axis of rotation are disposed in a region of the longitudinal axis of said housing; and said latching structure is disposed in a first edge region and/or a second edge region defining said side aperture relative to a height direction which extends transversely in relation to the longitudinal axis and the transverse axis.

6. The heat exchanger assembly according to claim 5, wherein said motor and the axis of rotation are disposed in said region of the longitudinal axis of said housing coaxially to the longitudinal axis.

7. The heat exchanger assembly according to claim 1, wherein said housing has a guide structure which extends in the transverse direction flush with said side aperture, said guide structure retains said fan relative to the longitudinal axis and guides said fan upon insertion into said side aperture in the transverse direction.

8. The heat exchanger assembly according to claim 1, wherein said side aperture is embodied in a region of said first aperture of said housing.

9. The heat exchanger assembly according to claim 8, wherein said housing has a first wall section which delimits said side aperture relative to the longitudinal axis in a first direction, and transverse webs which extend in the transverse direction, said transverse webs protrude into said first aperture on opposite sides and which delimit said side aperture in a second direction relative to the longitudinal axis, wherein said edge region of said fan is disposed relative to the longitudinal axis between said first wall section and said transverse webs.

10. The heat exchanger assembly according to claim 9, wherein said latching structure is disposed on said first wall section.

11. The heat exchanger assembly according to claim 9, wherein said heat exchanger is embodied as a micro channel heat exchanger.

12. The heat exchanger assembly according to claim 1, wherein said housing is formed from a solid material.

13. The heat exchanger assembly according to claim 12, wherein said housing is manufactured from a plastic material.

14. The heat exchanger assembly according to claim 1, wherein said housing is manufactured from polypropylene using an injection molded method.

15. A refrigeration appliance, comprising:

at least one refrigeration compartment for accommodating refrigerated goods;

a machine compartment separate from said at least one refrigeration compartment; and a refrigerant circuit for heat dissipation from said at least one refrigeration compartment to surroundings, wherein said refrigerant circuit has said heat exchanger assembly according to claim 1 and is disposed in said machine compartment.

16. The refrigeration appliance according to claim 15, wherein the refrigeration appliance is a household refrigeration appliance.

17. A method for manufacturing a heat exchanger assembly, which comprises the steps of:

inserting a heat exchanger into a receiving space of a housing, wherein the housing has a first aperture and a second aperture, between the first and second apertures the receiving space extends along a longitudinal axis, the heat exchanger being inserted into the receiving space in a region of, or adjacent to, the second aperture; and inserting a fan through a side aperture of the housing, the side aperture being situated at an axial end of the housing in a region of the first aperture, the fan being inserted into the receiving space along a transverse direction which extends transversely in relation to the longitudinal axis, such that an edge region of the fan is positioned in the side aperture and is latched to the housing by means of a latching structure embodied in a region of the side aperture.

18. A method for installing a fan in a housing of a heat exchanger assembly, the housing defining a receiving space extending between a first aperture and a second aperture along a longitudinal axis with a heat exchanger disposed in the receiving space in a region of, or adjacent to, the second aperture, the housing having a side aperture formed therein at an axial end of the housing in a region of the first aperture and a latching structure disposed in a region of the side aperture, the method comprises the steps of:

inserting the fan into the receiving space through the side aperture at an axial end of the housing in a region of the first aperture, the fan being inserted into the housing along a transverse direction which is transverse to the longitudinal axis such that an edge region of the fan is positioned in the side aperture and latching to the housing by means of the latching structure.

* * * * *